US006212924B1

(12) United States Patent
Meisser

(10) Patent No.: US 6,212,924 B1
(45) Date of Patent: Apr. 10, 2001

(54) PROCESS AND APPARATUS FOR DETERMINATION OF THE QUALITY OF A CRIMPED CONNECTION

(75) Inventor: Claudio Meisser, Cham (CH)

(73) Assignee: Komax Holding AG, Dierikon (CH)

( * ) Notice: Subject to any disclaimer, the term of this patent is extended or adjusted under 35 U.S.C. 154(b) by 0 days.

(21) Appl. No.: 09/544,699

(22) Filed: Apr. 6, 2000

Related U.S. Application Data

(62) Division of application No. 09/152,039, filed on Sep. 11, 1998, now Pat. No. 6,161,407.

(30) Foreign Application Priority Data

Sep. 11, 1997 (CH) ..... 97810648

(51) Int. Cl.[7] ..... B21C 51/00

(52) U.S. Cl. ..... 72/21.4; 72/20.2; 29/705; 29/753

(58) Field of Search ..... 72/20.1, 20.2, 72/21.4, 21.5; 29/593, 705, 715, 753, 863

(56) References Cited

U.S. PATENT DOCUMENTS 4,503,351 3/1985 Sonderegger et al. .
5,829,289 * 11/1998 Fisher et al. ..... 72/21.5
5,921,125 * 7/1999 Inoue et al. ..... 72/20.2
5,937,505 * 8/1999 Strong et al. ..... 72/21.4

FOREIGN PATENT DOCUMENTS 40 14 221 11/1990 (DE) .
40 38 658 6/1991 (DE) .
43 37 797 5/1995 (DE) .
291 329 11/1988 (EP) .

* cited by examiner

*Primary Examiner*—Ed Tolan
(74) *Attorney, Agent, or Firm*—Cohen, Pontani, Lieberman & Pavane

(57) ABSTRACT

A crimping press having a motor, a gear and first guides, at which a crimping ram is guided, arranged at a frame. A shaft driven by the gear has an eccentric spigot at one end and a resolver for the detection of the rotary angle coupled on at the other end. The crimping ram includes a sliding member guided in the first guides and a tool holder with force sensor and retaining fork. The sliding member stands in loose connection with the eccentric spigot, wherein the rotational movement of the eccentric spigot is translated into a linear movement of the sliding member. The tool holder usually actuates a tool which, together with an anvil belonging to the tool, produces the crimped connection. For calibration of the force sensor, a crimping simulator is used in place of the tool. For input of operational data and commands to a control, an operating terminal has a rotary knob and a keyboard. A display is provided for visualization of data. During the production of crimped connections, the quality of the crimped connections is checked by reference to a curve of the crimping force.

5 Claims, 11 Drawing Sheets

Fig. 17

| | zone 1 | zone 2 | zone 3 | Overall (all zones) | Limits |
|---|---|---|---|---|---|
| Width of zone n<br>W4=Width 90%-10% Fp zone 4 of the averaged reference curve | W1<br>e.g.1,0xW4<br>Range 0...2,0 | W1<br>e.g.1,0xW4<br>Range 0...2,0 | W1<br>90%-90% Fp | | |
| Sensitivity of zone n | S1<br>e.g.0,7<br>Range 0,5...1,0 | S2<br>e.g.0,7<br>Range 0,5...1,0 | S3<br>e.g.0,7<br>Range 0,5...1,0 | | |
| surface F<br>(averaged reference curve) | F1 | F2 | F3 | | |
| Result Signed [ppt]<br>relative to F3=1000 ppt | RS1 | RS2 | RS3 | | |
| Result Unsigned [ppt]<br>relative to F3=1000 ppt | RU1 | RU2 | RU3 | RU0<br>RU0=RU1+RU2+RU3 | |
| error type Bad Limit<br>actual Force-compensated, averaged reference | RS1 > BL1<br>$BL1 = BL0 \cdot \frac{W1}{W1+W2+W3} \cdot \frac{1}{S1}$ | RS2 > BL2<br>$BL2 = BL0 \cdot \frac{W1}{W1+W2+W3} \cdot \frac{1}{S2}$ | RS3 > BL3<br>$BL3 = BL0 \cdot \frac{W1}{W1+W2+W3} \cdot \frac{1}{S3}$ | RU0 > BL0 | BL0<br>e.g. 50 [ppt]<br>Range 10.....500 |
| error type Teach Limit<br>actual Force-first reference (no average) | RS1 > TL1<br>$TL1 = TL0 \cdot \frac{W1}{W1+W2+W3} \cdot \frac{1}{S1}$ | RS2 > TL2<br>$TL2 = TL0 \cdot \frac{W1}{W1+W2+W3} \cdot \frac{1}{S2}$ | RS3 > TL3<br>$TL3 = TL0 \cdot \frac{W1}{W1+W2+W3} \cdot \frac{1}{S3}$ | RU0 > TL0<br>TL0 = BL0 • T | T<br>e.g. 0,8<br>Range 0,5.....1,0 |
| error type Stop Limit<br>actual Force-compensated, averaged reference | RS1 > SL1<br>$SL1 = SL0 \cdot \frac{W1}{W1+W2+W3} \cdot \frac{1}{S1}$ | RS2 > SL2<br>$SL2 = SL0 \cdot \frac{W1}{W1+W2+W3} \cdot \frac{1}{S1}$ | RS3 > SL3<br>$SL3 = SL0 \cdot \frac{W1}{W1+W2+W3} \cdot \frac{1}{S3}$ | RU0 > SL0<br>SL0 = BL0 • S | S<br>e.g. 3,0<br>Range 2,0.....10,0 |
| error type Drift Limit<br>original reference-compensated, averaged reference | RS1 > DL1<br>$DL1 = DL0 \cdot \frac{W1}{W1+W2+W3} \cdot \frac{1}{S1}$ | RS2 > DL2<br>$DL2 = DL0 \cdot \frac{W1}{W1+W2+W3} \cdot \frac{1}{S2}$ | RS3 > DL3<br>$DL3 = DL0 \cdot \frac{W1}{W1+W2+W3} \cdot \frac{1}{S3}$ | RU0 > DL0<br>DL0 = BL0 • D | D<br>e.g. 3,0<br>Range 2,0.....10,0 |

Fig. 18a

| | Zone 1 | Zone 2 | Zone 3 |
|---|---|---|---|
| | ± | - - - | - - |
| Typ 1 | \|RS1\| < 0,50 BL1 | RS2 < -1,00 BL2 | RS3 < -0,75 BL3 |
| Typ 2 | \|RS1\| < 0,75 BL1 | RS2 < -1,50 BL2 | RS3 < -1,00 BL3 |
| Typ 3 | \|RS1\| < 1,00 BL1 | RS2 < -2,00 BL2 | RS3 < -1,50 BL3 |

Fig. 18b

| | Zone 1 | Zone 2 | Zone 3 |
|---|---|---|---|
| | + - + + | ± | ± |
| Typ 1 | RS 1 > +1,50 BL1 | \|RS2\| < 0,50 BL2 | \|RS3\| < 0,50 BL3 |
| Typ 2 | RS 1 > +2,00 BL1 | \|RS2\| < 0,75 BL2 | \|RS3\| < 0,75 BL3 |
| Typ 3 | RS 1 > +3,00 BL1 | \|RS2\| < 1,00 BL2 | \|RS3\| < 1,00 BL3 |

Fig. 18c

| | Zone 1 | Zone 2 | Zone 3 |
|---|---|---|---|
| | ± | - - - | - - - |
| Typ 1 | \|RS1\| < 0,50 BL1 | RS2 < -0,75 BL2 | RS3 < -1,00 BL3 |
| Typ 2 | \|RS1\| < 0,75 BL1 | RS2 < -1,00 BL2 | RS3 < -1,50 BL3 |
| Typ 3 | \|RS1\| < 1,00 BL1 | RS2 < -1,50 BL2 | RS3 < -2,00 BL3 |

PROCESS AND APPARATUS FOR DETERMINATION OF THE QUALITY OF A CRIMPED CONNECTION

This application is a Divisional of U.S. patent application Ser. No. 09/152,039, filed Sep. 11, 1998 now U.S. Pat. No. 6,161,407.

BACKGROUND OF THE INVENTION

1. Field of the Invention

The present invention relates to a process and an apparatus for determination of the quality of a crimped connection between a conductor and a contact. The crimping equipment produces a crimping force, by which the contact is connectable with the conductor so as to be electrically and mechanically non-detachable.

2. Description of the Related Art

The tern "crimping" is internationally established and standardized in terms of technique. In practice, however, expressions such as pressing, squeezing, fixing or attaching are also used. Under crimping, there is understood the production of a non-detachable electrical and mechanical connection between a conductor and a contact. During the crimping operation, the material to be connected is permanently plastically deformed. Poorly conducting surface layers, if present, are broken up, which promotes the electrical conductivity. A correct crimping, however, also prevents the ingress of corrosive media even under more difficult operational conditions such as temperature change or vibration.

The object of the crimping is the production of a good mechanical and electrical connection which remains unchanged qualitatively over a long period of time.

For crimping, contact-specific crimping tools are used with a stationary crimping anvil below and vertically displaceable crimping dies above (see FIGS. 1 to 3). A wire crimper and an insulation crimper are mounted in the crimping tool and can mostly be set to the wire diameter or the insulation diameter independently of each other in a vertical direction by way of raster discs with different height cams. These settings directly influence the quality of the crimped connection.

In the case of open crimped contacts (FIGS. 4 and 5) the conductive feed takes place above the contact. The conductor, previously stripped of insulation, is usually positioned correctly for the crimping operation relative to the contact, simultaneously in a radial and an axial direction, by automatic devices. Due to a downward movement of the crimping die, the conductor is first lowered by means of a mechanical system into the upwardly open wire and insulation crimping claws. The actual crimping operation begins thereafter with reshaping of the straps according to the crimping die shapes. After the stroke of the crimping dye, the crimp has the intended pressed shape (FIG. 5), which is in turn dependent on the contact sheet metal used, the wire cross-section, the copper of the wire and the insulation stripping. When the contacts are closed, the crimping region, shaped as a tube, must be entered axially in a radial orientation.

A sectional diagram of a faultlessly executed crimped connection shows the originally individual round flexible wires of the conductor pressed compactly one against the other into polygons. An internal surface in the crimped region of the contact shows deformations of the contact points of the individual flexible wires. In the wire crimping, all individual wires must be encompassed. The individual wires must, according to respective cross-section, project by about 0.5 millimeters out at a front end of the wire crimp and may not disappear in the crimp. The conductor and the conductor insulation must be visible in a window lying between the wire crimp and the insulation crimp. The insulation crimp must encompass the insulation without penetrating thereinto.

Important criteria for judgement of a crimped connection are the shape of the crimp, the height of the crimp and the resistance to tearing-out of wires. These kind of criteria are suitable however only during the setting-up of a crimping machine and in the case of random samples during production. In order to meet present-day quality requirements for all crimped connections, means must be available, which can receive, evaluate and store crimping data about each crimped connection during the crimping process so as to influence machine data in dependence on the result. For the judgement of the crimped connection (without mechanical destruction of the crimped connection), the crimping force is related to crimping travel or to crimping time. By appropriate evaluation of the crimp data, the quality of a crimped connection can be reliably judged.

The process or the apparatus for the judgement of the quality of a crimped connection must recognize crimping faults, such as, incorrect insulation crimp height, incorrect wire crimp height, not encompassed flexible wires, wrong or no stripped insulation length, wrong laying-in depth, and flexible wires cut off during the insulation stripping. Corresponding fault reports must then be provided.

A method for the detection of missing flexible wires, or of crimped-in conductor insulation in a crimped connection, by reference a graph of the crimping force, is known from the reference EP 0 460 441. Value pairs, consisting of crimping force and the position of the crimping die are measured during a crimping operation and stored. The value pairs are plotted on a graph to show the crimping force of the crimping operation in dependence on the position of the crimping die. A curve section of the graph, with a strong rise in force, is linearized and a point is determined from the mean of the minimum and the maximum crimping force. The point is compared with a reference value. If the point lies within a predetermined deviation from the reference value, the crimped connection is judged to be of acceptable quality. During the evaluation of the graph of the crimping force of the crimping operation, the maximum crimping force is also taken into consideration. If the maximum crimping force deviates excessively from a second reference value, the crimped connection is rejected as unusable. The point in the curved section with a strong rise in force and the maximum crimping force yield information related to missing flexible wires or crimped-in conductor insulation in the crimped connection.

In a crimping press common in the market, a force sensor detects the force, which is stored in digital form as a force-dependent curve course, during the crimping operation. This course is compared with a reference curve. The type of crimping fault is deduced in accordance with the magnitude of the deviation from the reference curve.

It is a disadvantage of this known process and apparatus that no differentiated statement about the quality of the crimped connection is possible in spite of great expenditure for the computer, memory and computing.

SUMMARY OF THE PRESENT INVENTION

It is an object of the present invention to overcome the disadvantages of the prior art. It is a further object to provide a process and apparatus having improved fault sensitivity.

The present invention advantageously provides a method for ascertaining the quality of a crimp connection between a conductor and a contact and, in particular, wherein crimping equipment produces a crimping force by which the contact is made connectable with the conductor so as to be electrically and mechanically nondetachable. The advantageous method of the present invention determines a reference crimping force curve which is divided into several zones. A curve of the crimping force for each zone is then evaluated with reference to the curve of the reference crimping force thereby enabling the production of fault reports and statements about the quality of the crimp connection. A typical crimping press includes a tool holder which actuates a tool that together with an anvil produces a crimp connection. Advantageously the present invention provides for the substitution of a crimping simulator in place of the tool. The crimping simulator allows a force sensor of the crimping press to be calibrated. During production of the crimp connections therefore the quality of the crimp connections is checked by reference to a curve of the crimping force.

The advantages achieved by the invention are to be seen substantially in that an increase in quality is possible by the better resolution of the faults, that fewer rejects arise with the more sensible fault diagnosis and that consequential faults, for example a breakdown of a passenger vehicle because of intermittent contacts in a plug connection, are avoided.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference numerals denote similar elements throughout the several views:

FIG. 17 shows a table of zone-dependent measured and computed values; and

FIGS. 18*a* to 18*c* show tables of limit values for fault types.

DETAILED DESCRIPTION OF THE PREFERRED EMBODIMENT

Figure 1:
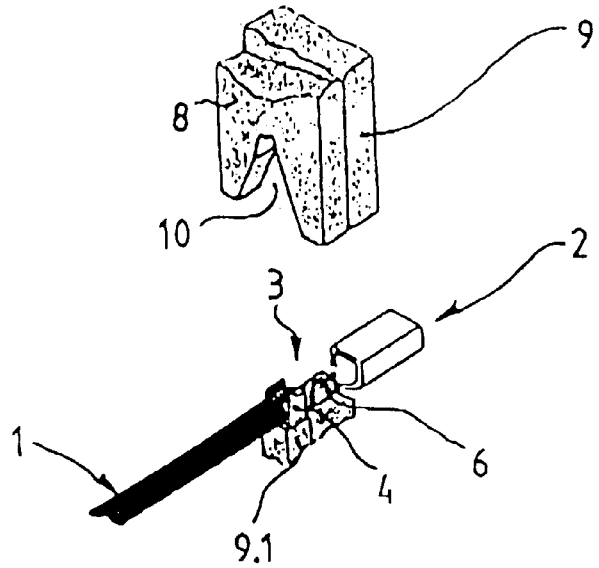
FIGS. 1 to 3 show a schematic illustration of a crimping operation.
Figure 2:
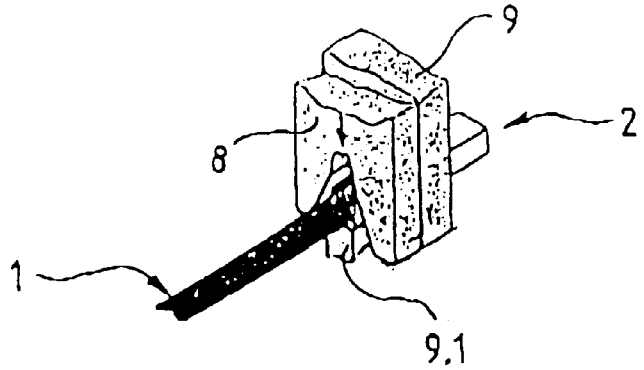
Figure 3:
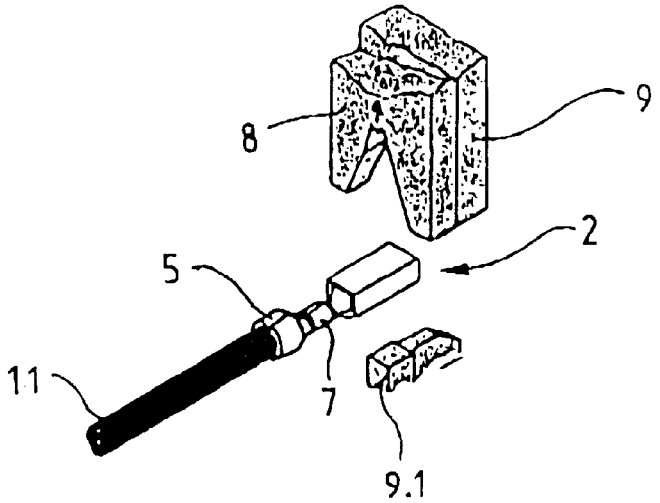

FIGS. 1 to 3 show a crimping operation in which an end of an insulated conductor 1 is connected to a contact 2. The contact 2 has an open crimp zone 3. Proximal the crimp zone 3 is a first double strap 4 for forming an insulation crimp 5 and a second double strap 6 for forming a wire crimp 7. FIG. 1 shows crimping dies 8, 9 in an upper dead center position above the conductor 1. The end of the conductor insulation rests in the first double strap 4 and a conductor portion stripped of insulation rests in the second double strap 6. Wedge-shaped recesses 10 are configured in the crimp dies 8, 9. As shown in FIG. 2, the double straps 4, 6 are pressed one against the other by the wedge-shaped recesses 10 of the crimping dies 8, 9 during lowering of the crimping dies 8, 9. An anvil 9.1 is placed below the conductor 1 to serve as a support. The recess 10 has a dome-shaped upper end which imparts a final shape to the double straps 4, 6 together with the conductor insulation or the conductor wire. FIG. 3 shows the finished crimped connection with the dies 8,9 and the anvil 9.1 removed from the connection. The first double strap 4 is pressed around the conductor insulation 11 so as form the insulation crimp 5. The second double strap 6 is pressed around a conductor wire 12 so as to form the wire crimp 7.

Figure 4:
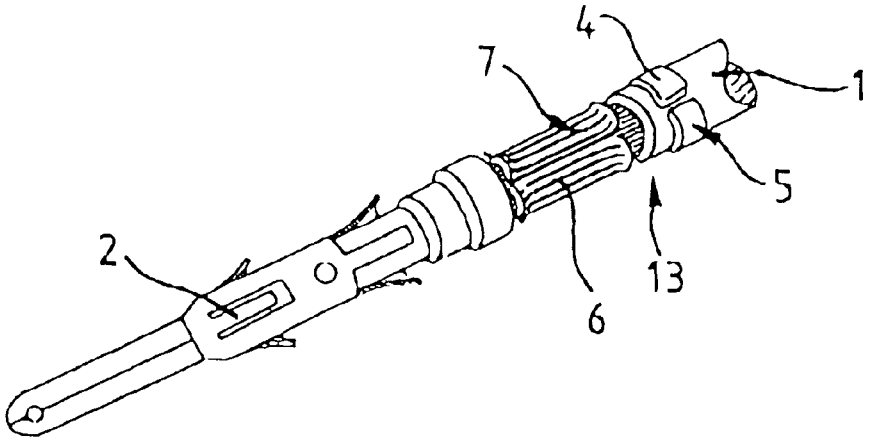
FIG. 4 shows a crimped connection between a conductor and a contact.

FIG. 4 shows a faultless crimped connection, having a window 13 through which the insulation 11 of the conductor end 1 and the individual flexible strands of the conductor wire 12 are visible. The individual flexible strands are also visible at the contact side end of the wire crimp 7.

Figure 5:
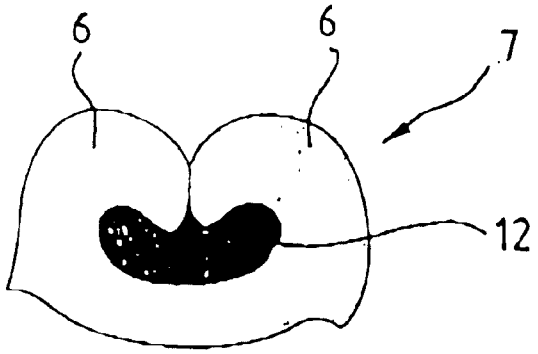
FIG. 5 shows details of a wire crimp.
Figure 6:
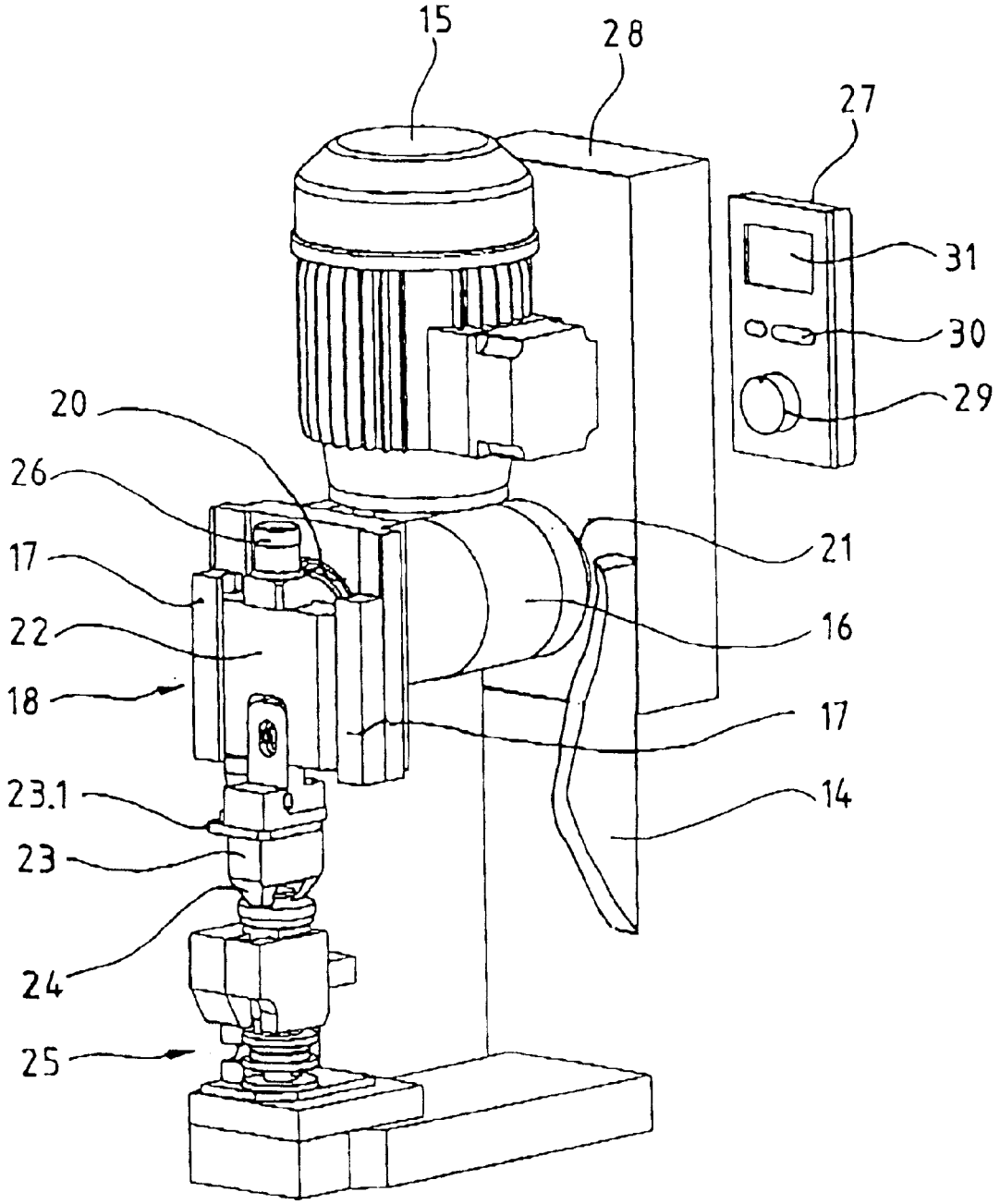
FIG. 6 shows a crimping press with a crimping simulator for calibration of a force sensor.

FIG. 5 shows the second double straps 6 squeezed together with the individual flexible strands of conductor wire 12, in the case of a faultless wire crimp 7.

A crimping press with a crimping simulator for calibration of a force sensor 23.1 is illustrated in FIGS. 6 to 12. The crimping press has a frame 14 without a right-hand side wall. A motor 15 and a gear 16 are mounted to the frame 14, the motor 15 being drivingly connected to the gear 16. First guides 17, at which a crimp ram 18 is guided, are arranged at the frame 14. A shaft 19 which is driven by the gear 16 has an eccentric spigot 20 arranged at one end and a resolver 21 for the detection of a rotary angle coupled on at the other end. The crimping ram 18 consists of a slide member 22 which is guided in the first guides 17 and of a tool holder 23 which has the fore sensor 23.1 and a retaining fork 24. The slide member 22 stands in loose connection with the eccentric spigot 20, so that rotational movement of the eccentric spigot 20 is converted into a linear movement of the slide member 22. A maximum stroke of the slide member 22 is determined by an upper dead center and a lower dead center of the eccentric spigot 20. The tool holder 23, in a conventional manner, actuates a tool including the anvil 9.1 to produce the crimped connection. For calibration of the force sensor 23.1, a crimping simulator 25 is used in place of the tool. An adjusting screw 26 is provided for precise adjustment of the stroke. An operating terminal 27 is provided so as to act as an interface between an operator and the crimping press. The operating terminal 27 comprises a rotary knob 29 and a keyboard 30 for the input of operational data and commands to a control 28. A display 31 is provided for visualization of data.

Figure 9:
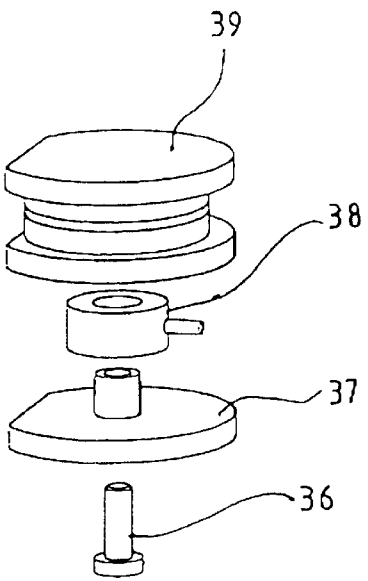
FIG. 9 shows details of the crimping insulator.
Figure 8:
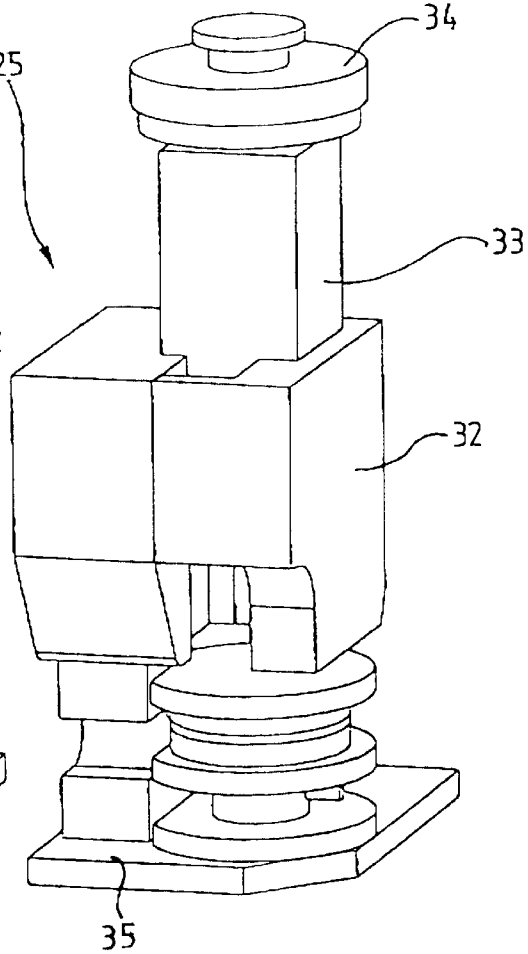
FIG. 8 shows the crimping simulator with the die in the upper dead center position.
Figure 7:
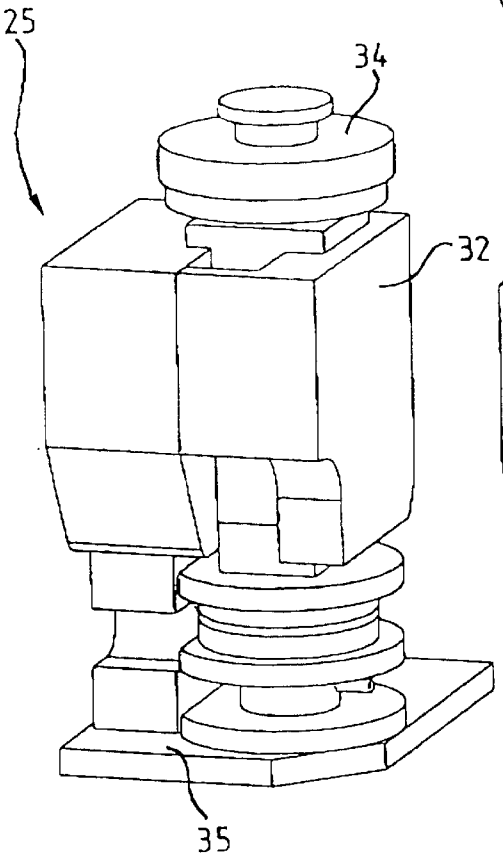
FIG. 7 shows the crimping simulator with a die in the lower dead center position.

FIGS. 7, 8 and 9 show details of the crimping simulator 25 for the calibration of the force sensor 23.1. A die 33 is slidably guided in a tool housing 32. A carrier head 34 is arranged at one end of the die 33 so as to be in loose connection with the retaining fork 24 of the tool holder 23. A base plate 37, which carries a force pick-up 38, is fastened, for example by means of a screw 36, at one foot 35 of the tool housing 32. An intermediate member 39 transmits the force of the die 33 to the force pick-up 38. The intermediate member 39 is elastic so that an increase in force is extended over time during the calibration. The force pick-up 38, for example a quartz force pick-up, is expensive, calibratable and has a very linear characteristic. The force sensor 23.1 built into the tool holder 23 on the other hand is cheaper and has a greater linearity error. For calibration of the force sensor 23.1, the die 33 is moved from the upper dead center position into the lower dead center position and then back to the upper dead center position. A force is produced in the course thereof being in the order of magnitude of a genuine crimping operation. The course of the force is detected simultaneously and exclusively by each of the force sensor 23.1 and by the force pick-up 38 and stored, wherein the force pick-up 38 detects a calibratable course of force. Thereby, a force calibration is possible at the force sensor 23.1. The course of the force, and force deviations from the measured course of the force, which are due to the non-linearity of the force sensor 23.1, are detected by the force pick-up 38 and filed in a correction table. After the calibration process, the crimping simulator 25 is taken out and the crimping tool is inserted. In the case that the force sensor 23.1 is replaced, the calibration process must be repeated. The force sensor 23.1 suffices for measuring the crimping force during the production of crimped connections because the force sensor 23.1 is calibrated and the measurement deviations caused by the non-linearity of the force sensor 23.1 are corrected by means of the correction table. In this manner, a course of the crimping force can be ascertained accurately and absolutely with an inexpensive force sensor 23.1 which in itself is inaccurate. It is furthermore advantageous that a maker of crimped connections needs only one expensive crimping simulator for the calibration of all crimping presses for his machine inventory, usually consisting of several like similar crimping presses.

Figure 9A:
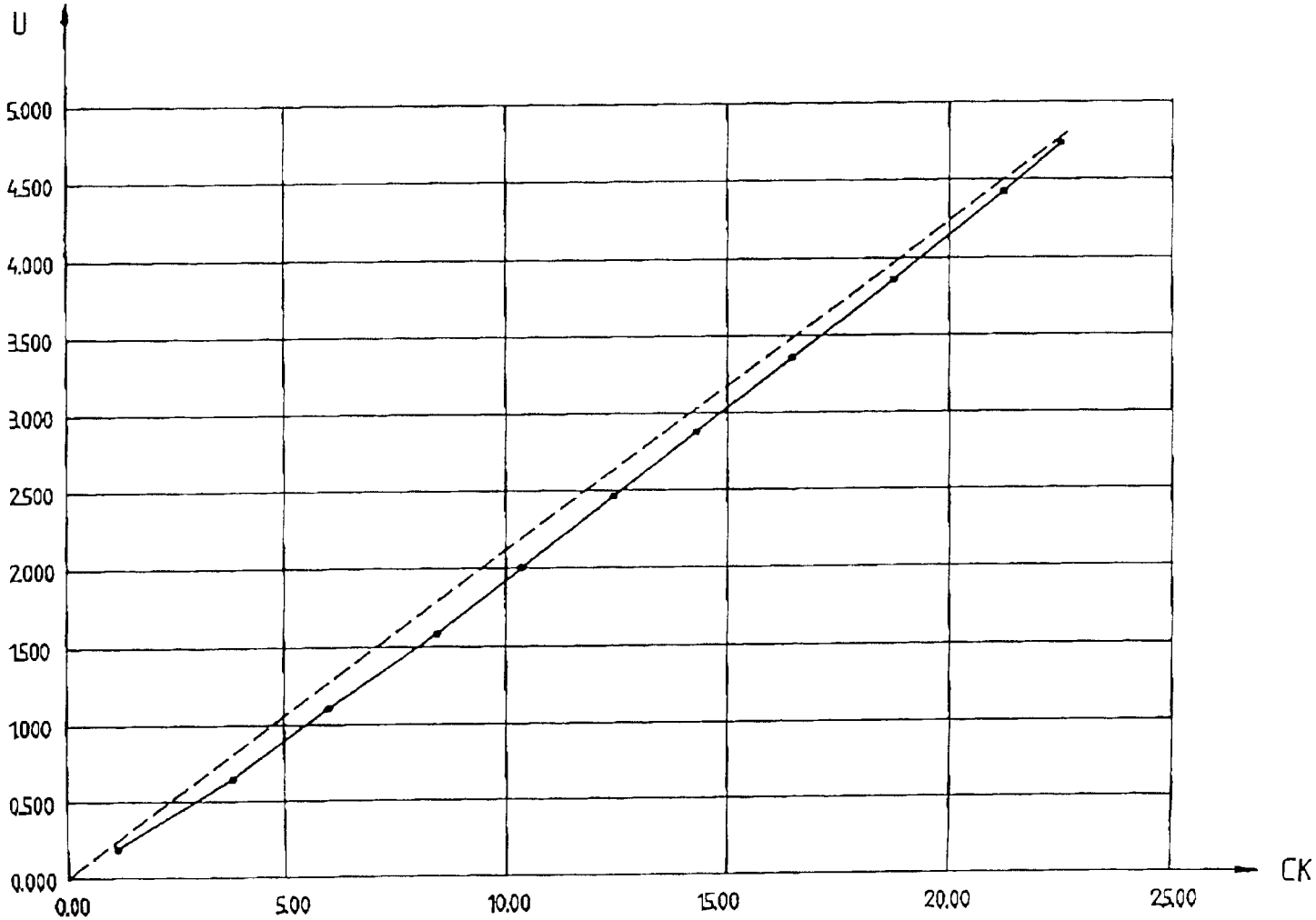
FIG. 9*a* shows a voltage-crimping force graph of the force sensor.

FIG. 9*a* shows a graph of voltage U in relation to crimping force CK of the force sensor 23.1. The voltage U, for example in volts, is entered on the vertical axis of the diagram and the crimping force CK, for example in kilonewtons, is entered on the horizontal axis of the diagram. A non-linear voltage of the force sensor 23.1 is illustrated by a solid line. The broken line shows a linear voltage curve of the crimping simulator 25. In the calibration process, respectively associated voltage differences between the non-linear and the linear curves are retained for, for example, 100 force values and filed in the aforementioned correction table as force/voltage value pairs. During the production of crimped connections, the corresponding force values are read from the correction table and the respectively associated voltage differences are added to corresponding actually measured voltages.

Figure 10:
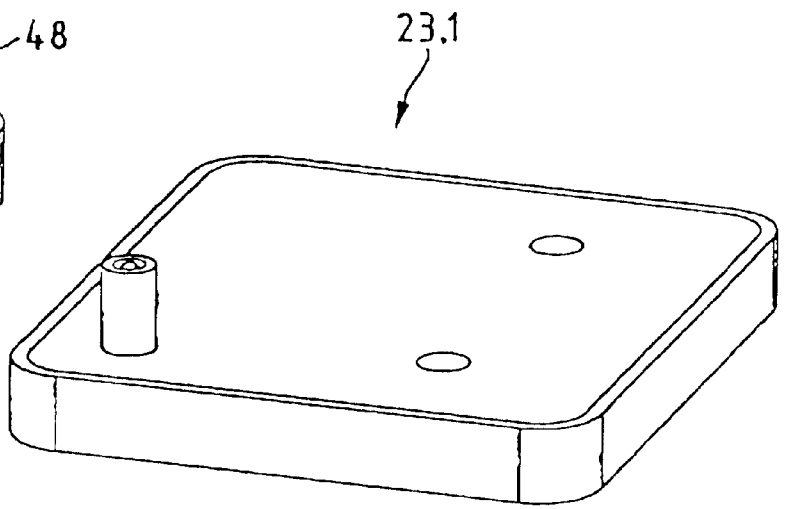
FIGS. 10 and 11 show details of the force sensor.
Figure 11:
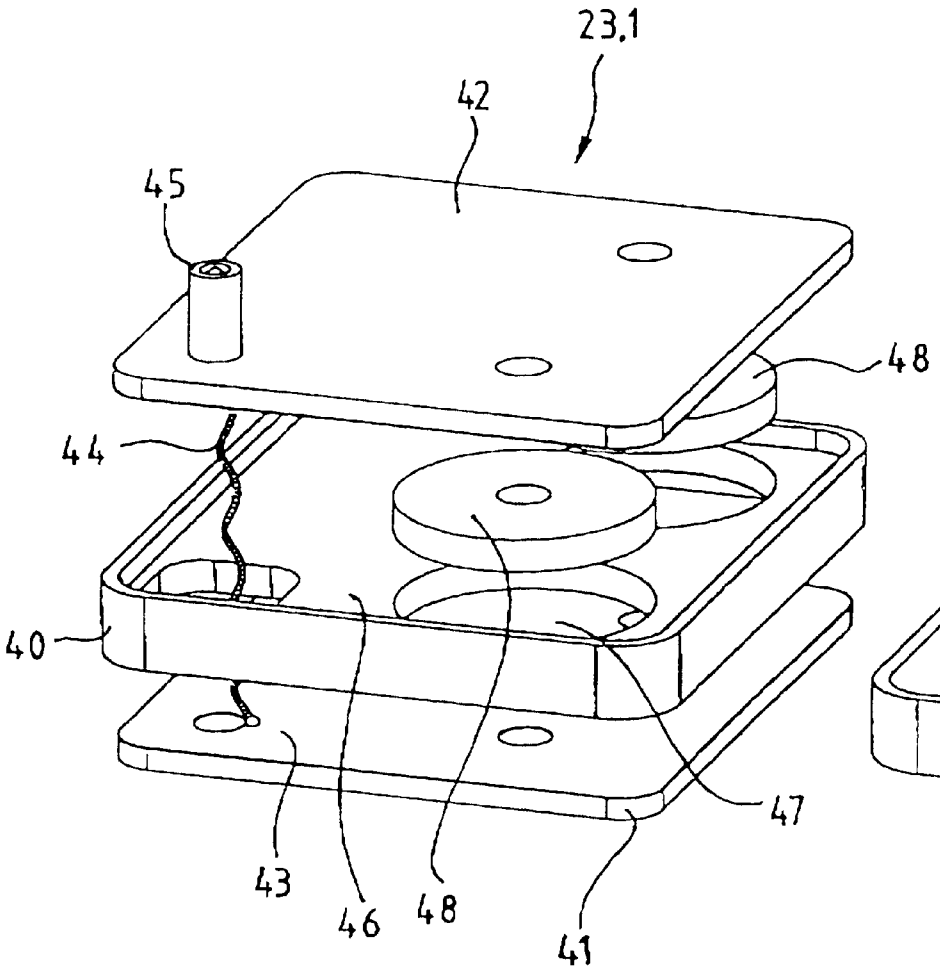

FIG. 10 shows the force sensor 23.1 as installed in the tool holder 23. FIG. 11 shows the individual parts of the force sensor 23.1. The force sensor 23.1 consists of a sensor housing 40 with a lid 42 and a base 41 configured, for example, of synthetic material. The inward sides of the base 41 and the lid 42 are laminated with an electrically conductive layer, for example a copper layer 43. The layer 43 of the base 41 is connected by means of a connecting wire 44 with an inner conductor of a connecting bush 45, a housing of the connecting bush 45 being connected directly with the coating of the lid 42. The sensor housing 40 includes a shelf 46 having recesses 47 arranged, for the retention of sensors 48, for example piezo-ceramic discs. The shelf 46 is configured of synthetic material of smaller thickness than the thickness of the sensors 48.

The force exerted on the lid 42 during the calibration process or the crimping operation is transmitted exclusively to the sensors 48 and from these to the base 41. The pressure exerted on the sensors 48 produces an electrical charge which is measurable at the connecting bush 45.

Figure 12:
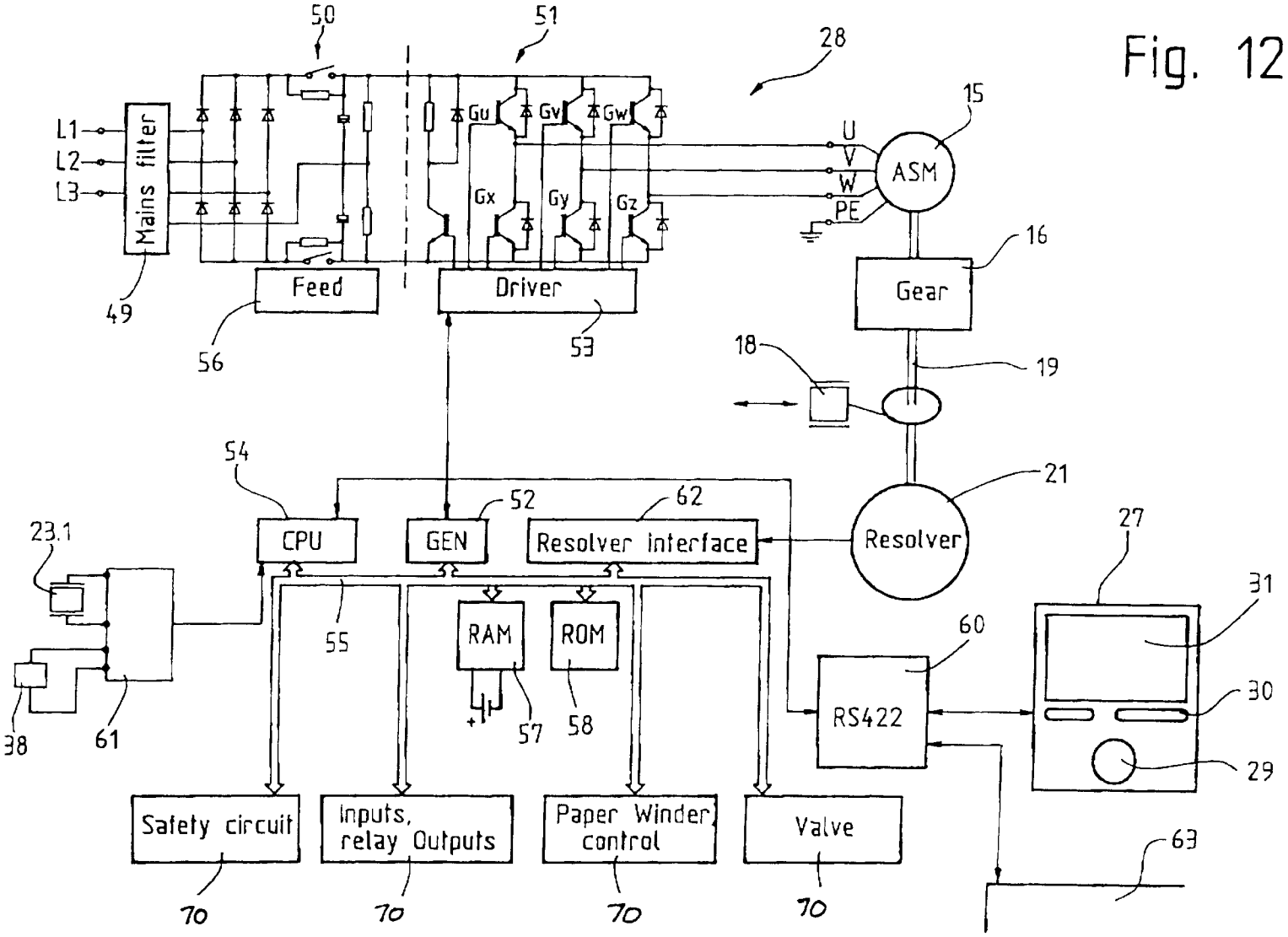
FIG. 12 shows details of a press control.

FIG. 12 shows details of the control 28 for the crimping press. A converter 50 equipped with a mains or power filter 49 at a main input L1, L2, L3 converts mains voltage into a direct current voltage which is fed to an inverter 51. The inverter 51 has controlled semiconductor switches Gu to Gz which chop the direct-current voltage by a pulse width modulation process into three pulsed alternating current voltages which produce sinusoidal currents of variable frequency in a motor 15, for example an asynchronous motor ASM. Rotational movement is transmitted from the motor 15 to the gear 16 and then to the shaft 19, at the one end of which the eccentric spigot 20 and at the other end of which the resolver 21 are arranged. Rotation of the eccentric spigot 20 produces a linear movement of the crimping ram 18. A pulse generator 52, in the function of a target speed course, generates a pulse pattern which is necessary for drive control of the semiconductor switches Gu to Gz. The pulse pattern is fed into a driver stage 53, having an output connected with control lines of the semiconductor switches Gu to Gz. A computer 54 controls all functions of the crimping press. A bus system 55 is provided for data exchange between the computer 54 and peripheral components. A mains unit 56, automatically adaptable to different mains situations, produces auxiliary voltages necessary for the operation of the control 28.

A battery-supported read-write memory 57 serves as working memory for the computer 54. The program for the control of the crimping press is filed in a read-only memory 58. Other machines participating in the crimping operation, such as for example conductor feed or contact feed, control equipment, safety loops and so forth are denoted by the reference symbol 70 and communicate, for example for synchronization, by way of the bus system 55 with the control 28. The operating terminal 27 is connected with the computer 54 by means of a serial interface 60. In case the crimping press belongs to a superordinate cable-finishing unit 63, the communication of the control 28 with the finishing unit 63 also takes place by way of the serial interface 60. An evaluating unit 61 detects the measurement values of the force sensor 23.1 and of the force pick-up 38 and processes the measurement data as explained above.

User-specific data such as password, speech, units and so forth, and operation-specific data such as acceleration, retardation, frequency of the motor, position points along the stroke for synchronization of the peripheral machines and equipment participating in the crimping operation, are entered, as for example by menu-guided means, at the operating terminal 27. Furthermore, system information data, service-relevant data, statistical evaluations, protocol data of the communication, drive data and so forth can be accessed by way of the operating terminal 27. Modes of operation such as calibration of the initial position of the crimping ram 18, calibration of the force sensor 23.1, setting-up operation for the presetting of the stroke necessary for the respective tool, initiation of a single crimping operation for the checking of the cumping connection, crimping operation with intermediate stop for positioning of the contact and subsequent compressing of the contact, crimping operation with preselected stroke and so forth can also be preset as for example by menu-guided means by way of the operating terminal 27 of the control 28, wherein the crimping ram 18 and thus the crimping tool are positionable by means of the rotary knob 29.

The resolver 21 is used in the crimping press for measurement of angular positions. The resolver 21 supplies an absolute signal for each revolution and is insensitive to vibration loadings and temperature. By reason of its mechanical build-up, its angle information is maintained even in the case of a voltage failure. The resolver 21 has a stator and a rotor driven by the shaft 19. A first stator winding and a second stator winding are arranged at the stator and a rotor winding is arranged at the rotor. The rotor winding is excited by an alternating current voltage U1 of constant amplitude and frequency, for example 5000 hertz. The second stator winding is arranged displaced through 90° relative to the first stator winding. By electromagnetic coupling, the alternating voltage U1 produces two voltages Usin and Ucos at terminals of the stator windings. The two voltages Usin, Ucos have the same frequency as U1. The amplitude is, however, proportional to the sine or cosine of mechanical deflection angle θ. A current feed of the rotor winding takes place by way of an oscillator. In the case of a resolver with one pole pair, the amplitude of the two voltages Usin, Ucos runs through a respective sinusoidal wave for each mechanical revolution. A resolver interface 62 evaluates the sine signal and the cosine signal of the resolver 21 with, for example, a resolution of 0.35°, and converts the angle θ into a digital value.

Figure 13:
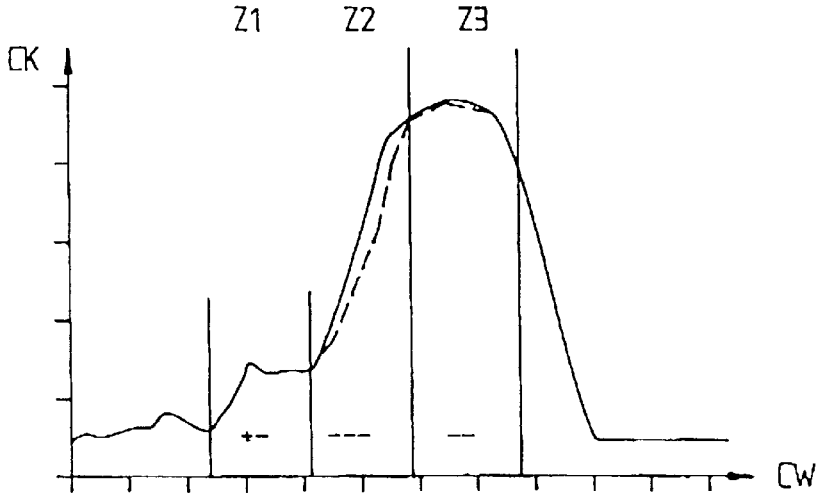
FIGS. 13 to 15 show graphs of the crimping force for different crimping faults.
Figure 14:
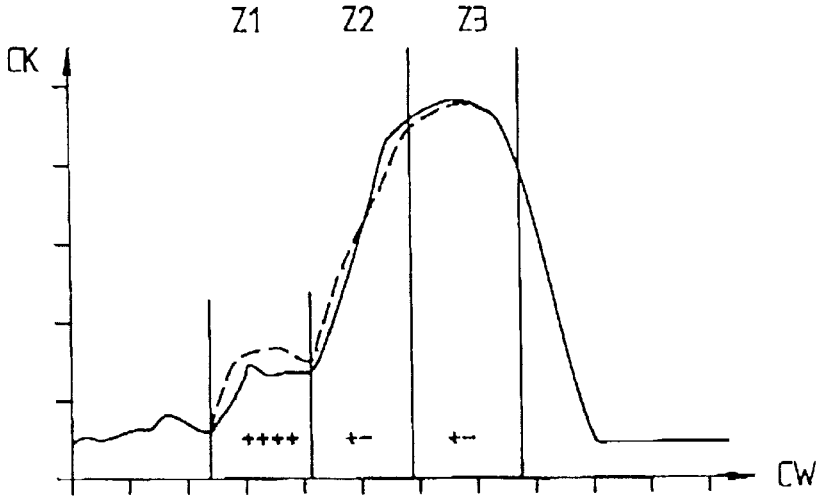
Figure 15:
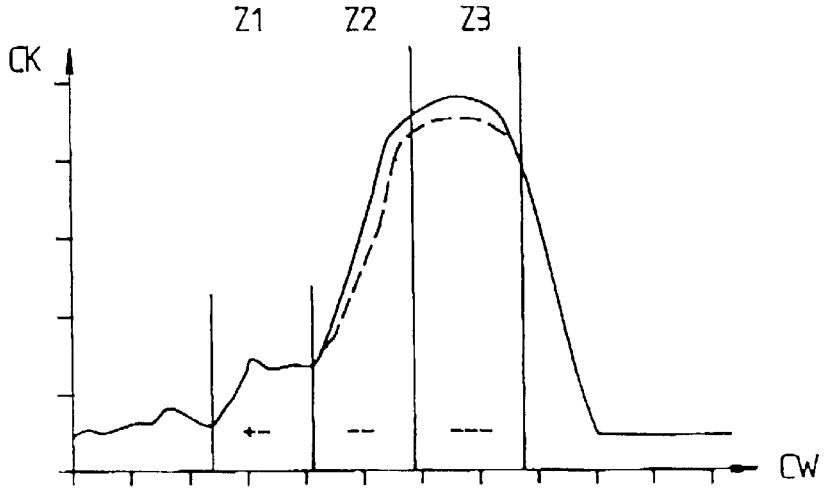

FIGS. 13 to 15 show graphs of the crimping force CK of a typical contact family for different crimping faults. The crimping force CK is entered on the vertical axis of the diagram and time, the deflection angle or crimping travel CW is entered on the horizontal axis of the diagram. The crimping travel CW is derived from the deflection angle θ of the resolver 21. The curve with a solid line is a reference curve ascertained, for example, from ten faultless crimpings and represents the mean value of these crimping forces. The curve of the force of a faulty crimping is illustrated by a broken line.

FIG. 13 shows the graph of the force of a crimping in which three of nineteen individual flexible wires of the conductor wire 12 are absent in the wire crimp 7. The three individual flexible wires have either been pushed back during the positioning of the conductor or were cut off during the insulation stripping. The reference curve and the curve of the faulty crimping lie one on the other, which is represented by the sign +–, in a first zone Z1 of the force curve, which approximately represents the closing operation of the double straps 4, 6. In a second zone Z2 of the force curve, which approximately represents the pressing of the first double strap 4 into the conductor insulation 11 and the pressing of the second double strap 6 into the conductor wire 12, the values of the faulty crimping lie significantly below the reference values, which is represented by the sign —. In a third zone Z3 of the force curve, which approximately reproduces the final plastic deformation of the double straps 4, 6, the values of the faulty crimping still lie somewhat below the reference values, which is represented by the sign —. The region to the right of the third zone Z3 reproduces the course of the force during the opening operation of the tool. In this region, the curves are congruent to a large extent independently of the fault of the crimping.

FIG. 14 shows the graph of the force of a crimping, in which the conductor insulation 11 reaches into the wire crimp 7. In the first zone Z1 and at the beginning of the second zone Z2, the course of the force of the faulty crimping displays a significant heightening relative to the reference curve, which is represented by the sign ++++. The closing of the second double strap 6 requires more force because of the conductor insulation 11.

FIG. 15 shows the graph of the force of a crimping, in which the conductor wire 12 reaches only partially into the wire crimp 7. In the second zone Z2 and in the third zone Z3, the course of the force of the faulty crimping lies significantly below the reference curve, which is represented by the sign — or by the sign —. The deformation of the double straps 4, 6 in the case of incompletely filled insulation crimp 4 and wire crimp 6 needs less force.

Figure 16:
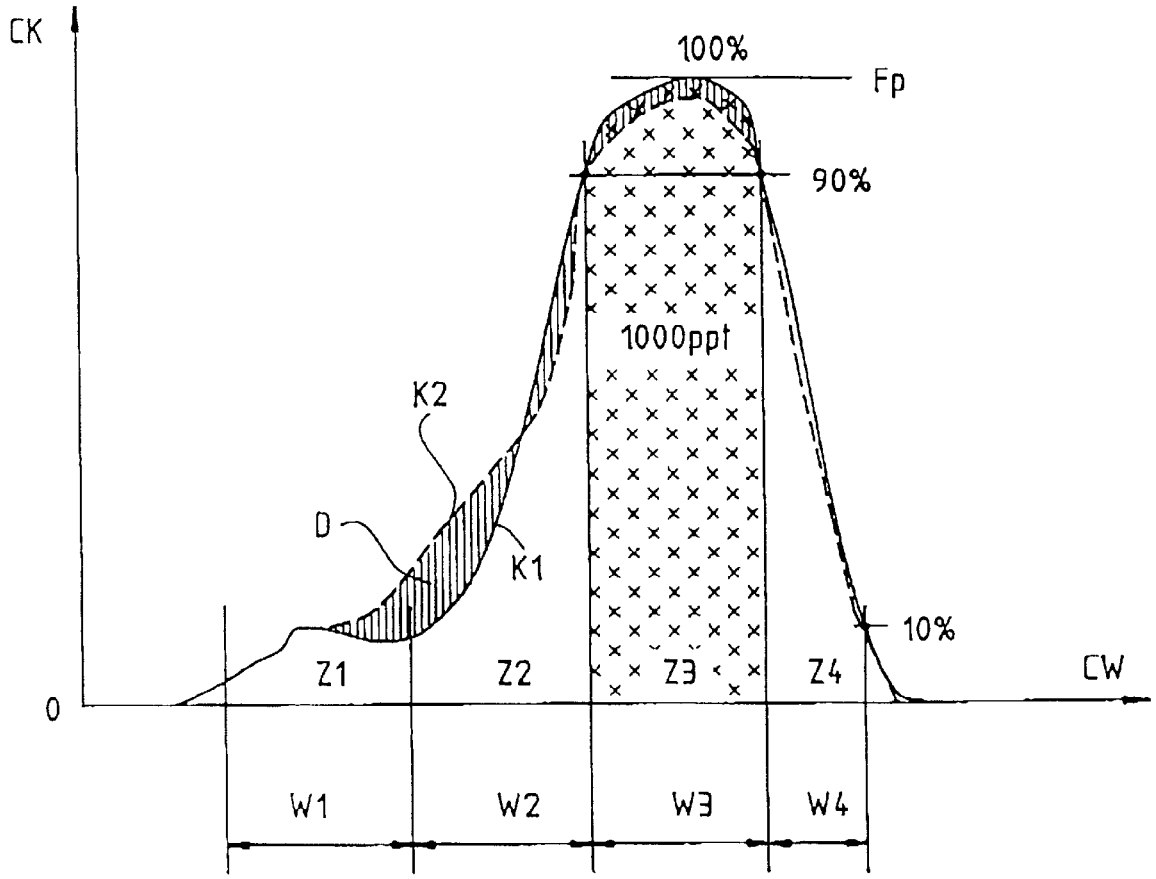
FIG. 16 shows a graph of the crimping force with a zone division.

FIG. 16 shows the graph of the crimping force CK with a zone division for evaluation of the deviations of the crimping force curve K2 of a crimping from a reference curve K1. The zone formation takes place, for example, on the basis of the peak width of the reference curve K1 and on the basis of the force decline between 90% and 10%. Other criteria for zone formation are impossible, such as for example a first zone Z1 at 20% of the maximum force with the disadvantage that the increase in force is very dependent on the contact and significant intermediate minima can be contained in the graph of the force. The zone division having fewer or more than four zones is also possible.

The zone widths of the zones Z1, Z2 and Z3 already mentioned in FIGS. 13 to 15 are denoted by W1, W2 and W3. The maximum crimping force during the crimping operation is denoted by Fp. The third zone Z3 reaches from the 90% point of the force increase up to the 90% point of the force decline. The area below the reference curve K1 of the width W3 is standardized to 1000 parts per thousand. The width belonging to the fourth zone Z4 from the 90% point to the 10% point of the force decline is denoted by W4. In this region, no significant deviations arise between the curves K1 and K2, because the curve of the force in the zone Z4 is determined substantially by the resilience of the contact and/or the crimping press. W4 can therefore be used as reference width for ascertaining the first width W1 and of the second width W2.

For evaluation, the area of the width W3 below the reference curve K1 and the area of the difference between the curves K1 and K2 are used theoretically. In practice, individual crimping forces D are measured at very small angular spacings preset, for example, by the resolver 21 and added up into areas.

FIG. 17 shows the relationships between factors, measurement values and computed values for the individual zones as well as also for all the zones together. It is possible on the basis of the measurement values and the computed values to make statements about the quality of a crimped connection and to generate fault reports.

For determination of the width of the first zone Z1 and of the second zone Z2, the fourth zone width W4 is multiplied by a factor in the order of magnitude of, for example, 0 to 2. The third zone width W3 is determined by the 90% points of the reference crimping force course K1. The averaged reference curve K1 is decisive for the zone width.

The different properties of the kinds of contacts to be processed are taken into consideration for each zone by means of a sensitivity factor S1, S2 and S3 in the order of magnitude of, for example, 0.5 to 1.

The respective area (surface) of a zone is denoted by F1, F2 and F3. The averaged reference curve K1 is decisive for the area.

A first measurement value (Result Signed) is the sum of the positive and the negative difference areas between the reference curve K1 and the crimping force curve K2. If the majority of the crimping force curve K2 lies above the reference curve K1, a positive area results. If the majority of the crimping force K2 lies below the reference curve K1, a negative area results. The first measurement value RS1 to RS3 is set up for the zones Z1 to Z3 and is represented in parts per thousand relative to the standardized area of the zone Z3.

A second measurement value (Result Unsigned) is the sum of the difference areas between the reference curve K1 and the crimping force curve K2 independently of whether the crimping force curve K2 lies above or below the reference curve K1. The second measurement value RU1 to RU2 is set up for the zones Z1 to Z3 and is represented in parts per thousand relative to the standardized area of the zone Z3. The total value RUO is the sum of the zone values RU1, RU2 and RU3.

The first measurement value RS1, RS2 and RS3 is compared with limit values (Limits) of the zones Z1, Z2 and Z3. In case at least one of the first measurement values exceeds the limit values, a corresponding fault report is produced. An averaged drift-compensated reference curve is decisive for the bad threshold (Bad Limit—BL), a first reference curve is decisive for the learning threshold (Teach Limit—TL) and the averaged drift-compensated reference curve is decisive for the stop threshold (Stop Limit—SL). For a drift threshold (Drift Limit—DL), the original reference curve is compared with the drift-compensated averaged reference curve. The computation of the respective limit values is evident from FIG. 17.

The first reference curve is the crimping force curve of the first crimping. The averaged reference curve is the mean of the crimping force curves of, for example, the first five crimpings and is filed as an original reference curve. The drift-compensated averaged reference curve is the averaged reference curve after the drift has been tracked. The drift is ascertainable by reference to deviations from crimping force courses evaluated as good. The tracking takes place with only a small portion of the ascertained deviations.

According to FIG. 17, the total value RUO is compared with total limit values which are factors or values computed from factors. The respective decisive curves are the same as described in the preceding paragraph.

Of the factors mentioned in FIG. 17, merely the factor BLO need be determined by the user, the remaining ones being preset by the manufacturer. The user has, however, the possibility of adapting all factors to the user's requirements at any time.

With the zone evaluation, faults in individual zones can be detected substantially more sensibly than with an overall evaluation. The overall evaluation is rather to be preferred in the case of unclear, blurred fault causes.

The first measurement values RS1 to RS3 are used not only for the initiation of fault reports, but also for statements about the fault and the probability that a specific fault is concerned. In case the limit values of type 1 occur as shown in FIG. 18*a*, it is fairly certain that, for example, more than 10% individual flexible wires are absent in the wire crimp 7. In case the limit values of type 2 occur, it is certain that, for example, more than 10% of the individual flexible wires are absent in th wire crimp 7. In case the limit values of type 3 occur, it is quite certain that, for example, more than 10% of the individual flexible wires are missing in the wire crimp 7. FIG. 18*b* shows the limit values for crimpings with conductor 1 laid in too deeply. FIG. 18*c* shows the limit values for crimpings with a conductor 1 laid in not deeply enough. In the case of the boldly printed limit values, corresponding fault reports are initiated.

A further possibility for improvement in the fault sensitivity exists in that the averaged increase of the crimping force curve is detected at the zone transitions. Thereby, for example, the fault type of the zone 2 of FIG. 18*a* can be distinguished more precisely from the fault type of the zone 2 of FIG. 18*c*.

As mentioned above, the crimping force CK is measured by means of a force sensor 23.1. The crimping force CK is distributed among the crimping dyes 8, 9. The aforementioned crimping force evaluation can also be applied to a crimping press, in which the crimping force is measured for each crimping dye. Thereby, precise statements about the crimping force course in the crimping dye 8 for the insulation crimp 5 and about the crimping force course in the crimping dye 9 for the wire crimp 7 and thus about the quality of the insulation crimp 5 and the wire crimp 7 are possible.

The invention is not limited by the embodiments described above which are presented as examples only but can be modified in various ways within the scope of protection defined by the appended patent claims.

I claim:

1. A crimping apparatus for producing a crimping force by which a contact is made connectable with a conductor so as to be electrically and mechanically non-detachable therefrom, comprising: means for driving a crimping tool having two crimping dies; means for controlling the driving means; a transmitter operatively arranged to ascertain a crimping travel; and a force sensor operatively arranged to ascertain the crimping force, one said force sensor being provided for each crimping die, each force sensor having at least one horizontally arranged piezo-electric element.

2. The crimping apparatus according to claim 1, further comprising a housing having a base and a lid, the at least one piezo-electric element being arranged between the base and the lid of the housing, and an electrically conductive coating arranged at an inward side of the base and at an inward side of the lid.

3. The crimping apparatus according to claim 1, further comprising crimping simulator means interchangeable with the crimping tool for enabling a precise detection of the crimping force during a calibration process.

4. The crimping apparatus according to claim 3, wherein the control means includes a correction table in which force deviations caused by non-linearity of the force sensor from a course of the force measured by the crimping simulator means are stored, the force sensor being calibratable to a course of the force by means of the crimping simulator.

5. The crimping apparatus according to claim 4, wherein the control means includes correction equipment operative to linearize the curve of the crimping force ascertained by the force sensor during the crimping operation in dependence upon parameters related to the correction table.

* * * * *